US008984724B2

(12) United States Patent
Kinney

(10) Patent No.: US 8,984,724 B2
(45) Date of Patent: Mar. 24, 2015

(54) GARMENT CLIP SYSTEM FOR HANGERS

(71) Applicant: Johnette Amanda Kinney, McKinney, TX (US)

(72) Inventor: Johnette Amanda Kinney, McKinney, TX (US)

( * ) Notice: Subject to any disclaimer, the term of this patent is extended or adjusted under 35 U.S.C. 154(b) by 0 days.

(21) Appl. No.: 13/925,783

(22) Filed: Jun. 24, 2013

(65) Prior Publication Data

US 2013/0340212 A1 Dec. 26, 2013

Related U.S. Application Data

(60) Provisional application No. 61/690,230, filed on Jun. 22, 2012.

(51) Int. Cl.
*A44B 1/04* (2006.01)
*A47G 25/48* (2006.01)

(52) U.S. Cl.
CPC ..... *A47G 25/48* (2013.01); *A47G 25/486* (2013.01)
USPC ..... 24/300

(58) Field of Classification Search
USPC ..... 24/300, 298, 301, 457; 223/85, 88–91, 223/93, 94, 96, 98
See application file for complete search history.

(56) References Cited

U.S. PATENT DOCUMENTS

| | | | | | |
|---|---|---|---|---|---|
| 1,009,522 | A * | 11/1911 | Hunter | 223/90 |
| 2,888,725 | A * | 6/1959 | Cudd | 24/531 |
| 4,877,163 | A * | 10/1989 | Zimmerman | 223/93 |
| 5,868,369 | A * | 2/1999 | Montgomery | 248/214 |
| 6,273,376 | B1 * | 8/2001 | Montgomery | 248/214 |
| 7,455,202 | B2 * | 11/2008 | Shimura | 223/89 |
| 2004/0084487 | A1 * | 5/2004 | Keating | 223/93 |
| 2007/0261212 | A1 * | 11/2007 | Russell | 24/298 |
| 2010/0258599 | A1 * | 10/2010 | Sugita et al. | 223/96 |
| 2011/0252604 | A1 * | 10/2011 | Hansen | 24/301 |

* cited by examiner

*Primary Examiner* — Victor Batson
*Assistant Examiner* — Matthew Sullivan
(74) *Attorney, Agent, or Firm* — Mark David Torche; Patwrite LLC

(57) ABSTRACT

A garment clip system for hangers for adjustably holding various clothing has a cover that fits over a central portion of a hanger and has two clips moveably mounted along a portion of hanger that clips cloths to hold them to the hanger. An elastic cord connects each clip to the cover and keeps the clips in a selected place. A closure is disposed along the bottom that opens to allow a user to attach garment clip system for hangers to any hanger. A hook and loop connector is used to keep closure closed. In another embodiment, a retractor is mounted within cover to keep tension on a retractable cord that connects the clips. The retractor is biased using a spring to keep the desired tension on the cords.

7 Claims, 5 Drawing Sheets

GARMENT CLIP SYSTEM FOR HANGERS

CROSS REFERENCE TO RELATED APPLICATIONS

This application claims priority and herein incorporates by reference U.S. provisional patent application 61/690,230, filed Jun. 22, 2012.

BACKGROUND OF THE INVENTION

Most people have closets to hang their clothes and hangers are used to hang and organize the clothes. Thomas Jefferson is credited with invention the first wooden clothes hanger. Wire clothes hangers came next and are still used today. The most widely used clothes hangers are made of plastic and come in many sizes. Although hangers are used to hang clothes, some clothes items are difficult to get to stay on the hanger and fall to the floor to wrinkle and soil. There is a need for a hanger that securely holds all kinds of clothes without letting them fall off.

SUMMARY OF THE INVENTION

A garment clip system for hangers for adjustably holding various clothing has a cover that fits over a central portion of a hanger and has two clips moveably mounted along a portion of hanger that clips cloths to hold them to the hanger. An elastic cord connects each clip to the cover and keeps the clips in a selected place. A closure is disposed along the bottom that opens to allow a user to attach garment clip system for hangers to any hanger. A hook and loop connector is used to keep closure closed. In another embodiment, a retractor is mounted within cover to keep tension on a retractable cord that connects the clips. The retractor is biased using a spring to keep the desired tension on the cords.

Other features and advantages of the instant invention will become apparent from the following description of the invention which refers to the accompanying drawings.

DETAILED DESCRIPTION OF THE INVENTION

Figure 1:
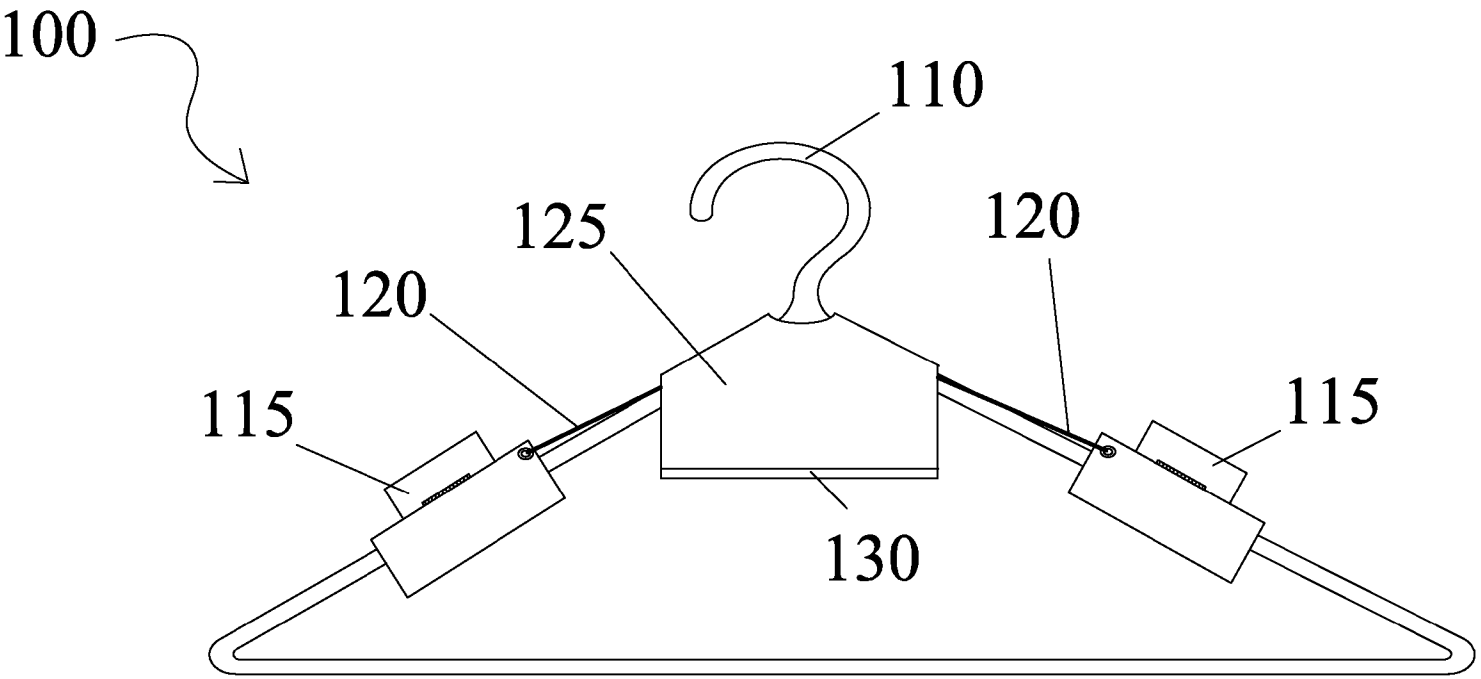
FIG. 1 is a side view of a garment clip system for hangers according to an embodiment of the invention.
Figure 2:
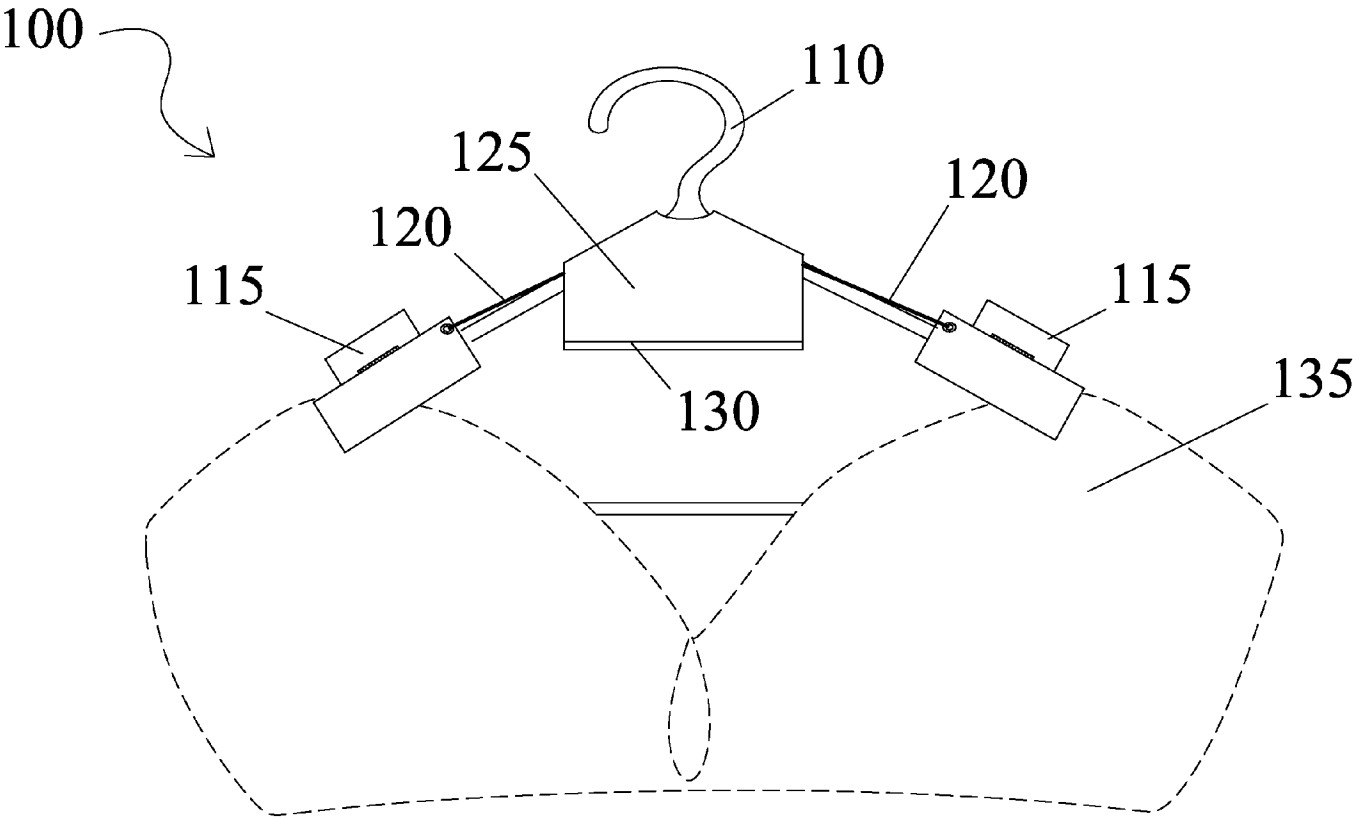
FIG. 2 is a side view of the garment clip system for hangers shown in FIG. 1 with a garment hung thereon.
Figure 3:
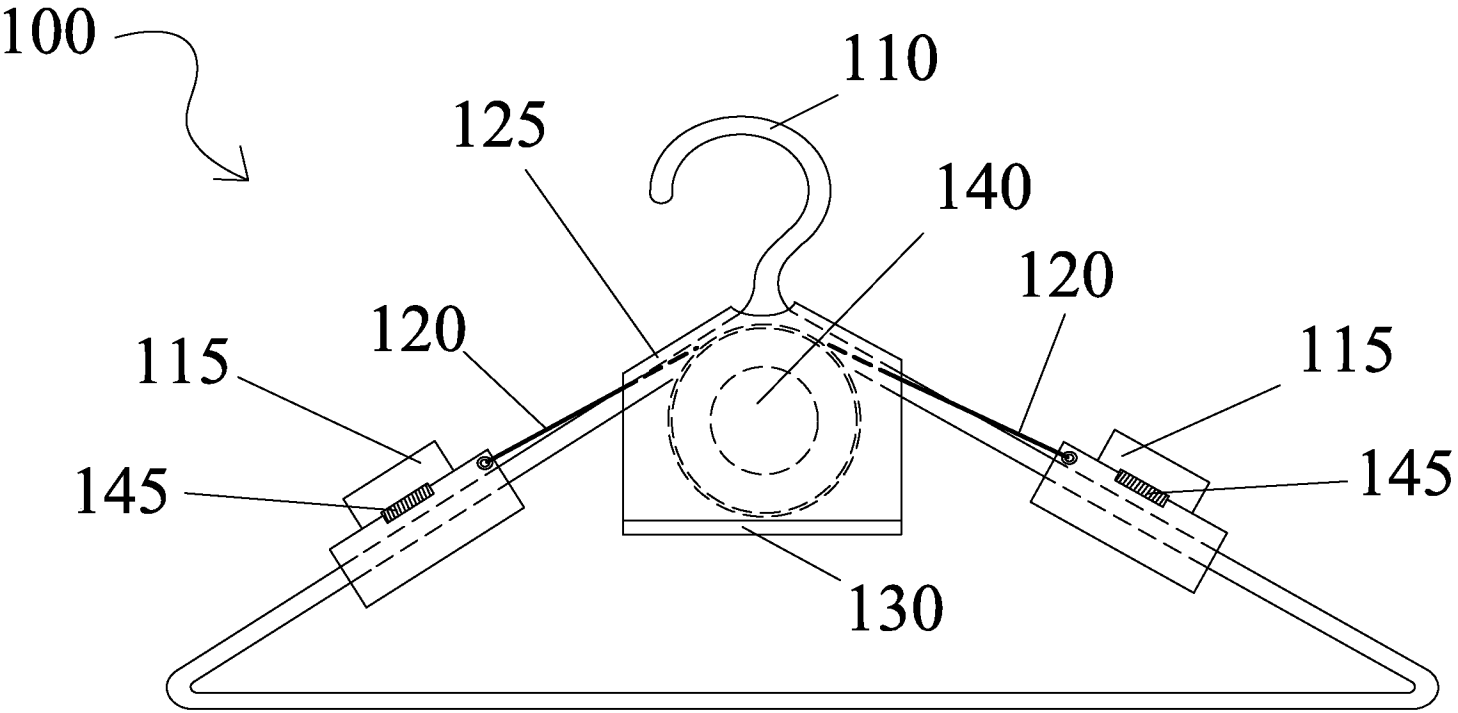
FIG. 3 is a transparent side view of the garment clip system for hangers shown in FIG. 1.
Figure 4:
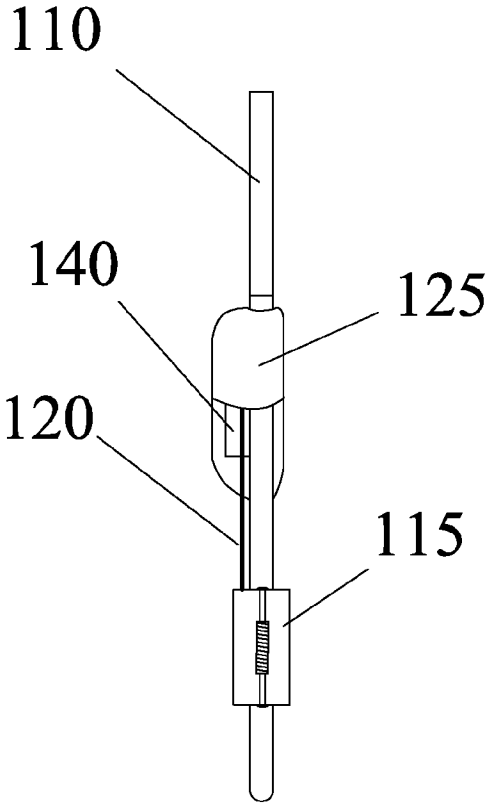
FIG. 4 is an end view of the garment clip system for hangers shown in FIG. 1.

In the following detailed description of the invention, reference is made to the drawings in which reference numerals refer to like elements, and which are intended to show by way of illustration specific embodiments in which the invention may be practiced. It is understood that other embodiments may be utilized and that structural changes may be made without departing from the scope and spirit of the invention.

Referring to FIGS. 1-4, a garment clip system for hangers 100 is shown having a hanger 110 that has a hook portion to hang on a closet clothes rod (not shown). A pair of clips 115 fit over hanger 110 and are spring loaded using spring 145 as is known in the art. A retractable cord 120 connects clips 115 to a retractor 140 that is also spring loaded to keep clips 115 from changing position. Retractable cords 120 may be wound in an opposite direction from each other to provide for equal movement of clips 115 when retractor 140 is rotated in one direction. Additionally, retractor 140 may be stationary and cords 120 may be elastic to allow movement. A cover 125 is provided to cover retractor 140 and a hook and loop closure portion 130 is provided to secure cover 125 in place over the hook portion of hanger 110.

Clips 115 are made of plastic and are rigid enough to hold clothes (not shown) in place on hanger 110. Of course other materials may be used, such as but not limited to metal, wood or other suitable material. Hanger 110 may be made of wood, metal or plastic or any other suitable material.

It is expected that garment clip system for hangers 100 may be sold as part of the original hanger in manufacture. In an embodiment where it is installed as part of the manufacturing process, closure portion 130 may be eliminated. Additionally, closure portion may use other closing means, such as but not limited to snaps, zippers, hooks, etc. as long as retractor 140 is covered securely. Cover 140 is made of fabric and may be decorative to enhance the esthetic appeal. Also, cover 140 may be made of metal or other suitable material.

Clips 115 need to be able to change position up and down hanger 110 to fit different types of clothes. Some clothes have a little strap, some have shoulder pads, etc. so different types of clothes can be accommodated by simply moving the position of clips 115.

Figure 5:
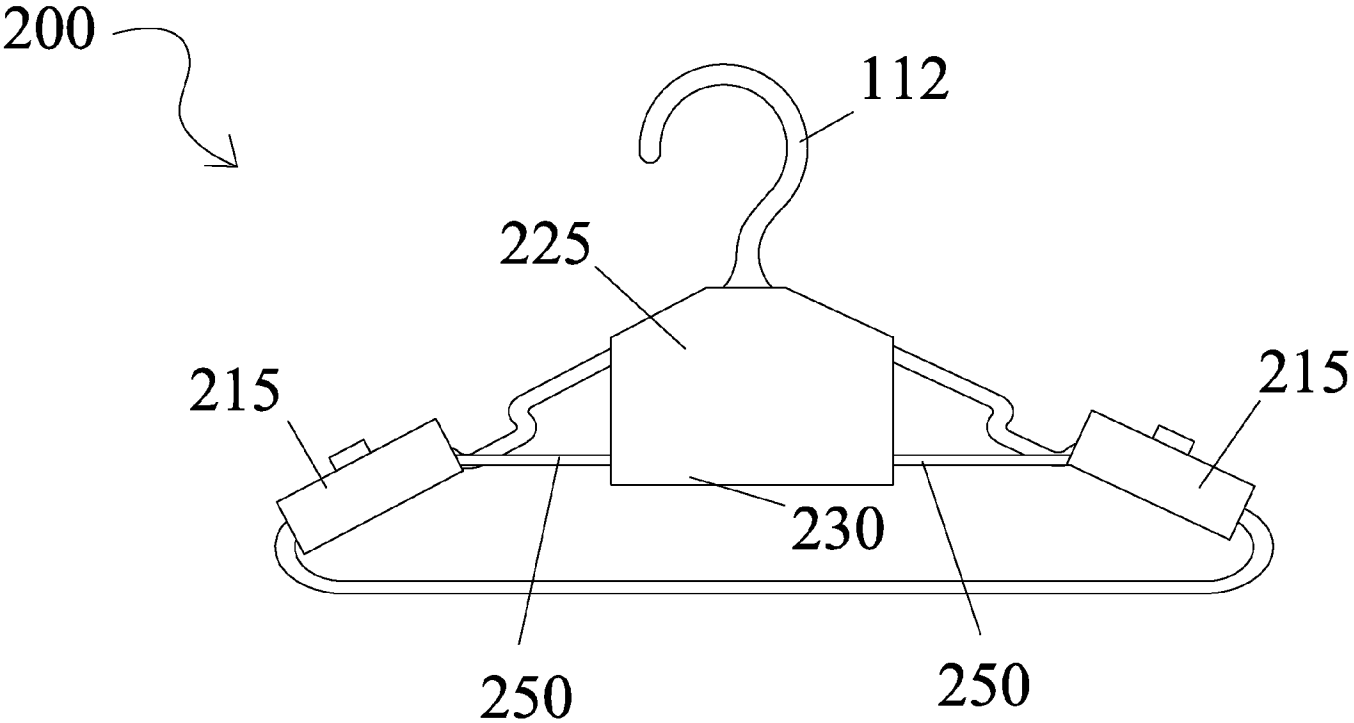
FIG. 5 is a side view of a garment clip system for hangers according to an embodiment of the invention.

Now referring to FIG. 5, a garment clip system for hangers 200 is shown having a hanger 112 with a slip cover 225. Two clips 215 are provided to clip clothes on hanger 112. An elastic cord 250 is used to elastically connect clips 215 to slip cover 225. Elastic cords 250 may be stitched to cover 225 or may be attached by any other suitable method such as; but not limited to, glue, rivets or combination as long as they are securely attached. Additionally, although elastic cords 250 are shown attached horizontally, they may be attached at any suitable angle as this will not interfere with their operation. A hook and loop closure 230 is provided to secure slip cover 230 to hanger 112. In this embodiment, clips 215 are adjusted by merely starching them to the desired location. Elastic cords 250 are made of a flexible material that can be braided or woven to further enhance durability as is known in the art. Additionally, other suitable stretchy materials such as rubber may be used as long as clips 215 may be moved to a selected position to hold clothes.

Again, as discussed above, if garment clip system for hangers 200 is provided as a part of the manufacturing process, closure 230 may be eliminated. Closure 230 is provided to allow a user to use garment clip system for hangers 200 with any suitable hanger; therefor, not requiring the user to purchase a specific hanger for use.

Although the instant invention has been described in relation to particular embodiments thereof, many other variations and modifications and other uses will become apparent to those skilled in the art.

What is claimed is:

1. A garment clip system for hangers for adjustably holding various clothing items comprising:

a cover adapted to fit over a central portion of a hanger;

said hanger having an arm portion on each side of said central portion for holding a garment;

a clip disposed on each side of said cover;

each of said clip is slidably movable along said arm portion and fits over and encloses a portion of said arm portion wherein each of said clip is stabilized and constrained to move only along said arm portion;

an elastic cord connecting each said clip to said cover; and said clip having a biasing spring adapted to moveably keep clip closed.

2. The garment clip system for hangers for adjustably holding various clothing items according to claim 1 further comprising a closure means disposed along a bottom portion of said cover where said cover is adapted to fit over said hanger.

3. The garment clip system for hangers for adjustably holding various clothing items according to claim 2 wherein said closure means is a hook and loop fastener.

4. The garment clip system for hangers for adjustably holding various clothing items according to claim 1 wherein said cover is made of fabric.

5. A garment clip system for hangers for adjustably holding various clothing items comprising:

a cover adapted to fit over a central portion of a hanger;

said hanger having an arm portion on each side of said central portion for holding a garment;

a clip disposed on each side of said cover;

each of said clip is slidably movable along said arm portion and fits over and encloses a portion of said arm portion wherein each of said clip is stabilized and constrained to move only along said arm portion;

a retractable cord connected to each said clip;

a retractor rotationally mounted within said cover adapted to bias said retractable cord; and said clip having a biasing spring adapted to moveably keep clip closed.

6. The garment clip system for hangers for adjustably holding various clothing items according to claim 5 further comprising a closure means disposed along a bottom portion of said cover where said cover is adapted to fit over said hanger.

7. The garment clip system for hangers for adjustably holding various clothing items according to claim 6 wherein said closure means is a hook and loop fastener.

* * * * *